US006305639B1

(12) United States Patent
Bocciola

(10) Patent No.: US 6,305,639 B1
(45) Date of Patent: Oct. 23, 2001

(54) REEL AND METHOD FOR SUPPORTING OPTICAL FIBRES

(75) Inventor: Lorenzo Bocciola, Casal Buttano (IT)

(73) Assignee: Pirelli Cavi e Sistemi S.p,A., Milan (IT)

( * ) Notice: Subject to any disclaimer, the term of this patent is extended or adjusted under 35 U.S.C. 154(b) by 0 days.

(21) Appl. No.: 09/564,543

(22) Filed: May 4, 2000

Related U.S. Application Data

(63) Continuation of application No. PCT/EP98/06969, filed on Nov. 4, 1998.
(60) Provisional application No. 60/064,470, filed on Nov. 6, 1997.

(30) Foreign Application Priority Data

Nov. 6, 1997 (EP) ..... 97119380

(51) Int. Cl.[7] ..... B65H 75/08; B65H 75/14
(52) U.S. Cl. ..... 242/613.4; 242/118.6; 242/608.8; 242/614.1
(58) Field of Search ..... 242/613.4, 118.6, 242/608.8, 608, 614.1

(56) References Cited

U.S. PATENT DOCUMENTS

| | | | | |
|---|---|---|---|---|
| 2,208,456 | * | 7/1940 | Howsam | 242/118.6 |
| 2,605,058 | * | 7/1952 | Howsam | 242/118.6 |
| 2,662,701 | * | 12/1953 | Weber | 242/608.8 X |
| 4,269,371 | * | 5/1981 | Kovaleski | 242/118.6 |
| 4,657,203 | | 4/1987 | Crawford . | |
| 4,696,438 | | 9/1987 | Myers . | |
| 5,236,145 | | 8/1993 | Floury et al. . | |
| 5,718,397 | * | 2/1998 | Stevens | 242/608.8 |
| 6,036,138 | * | 3/2000 | Sexton et al. | 242/608.8 |
| 6,138,942 | * | 10/2000 | DesRosiers et al. | 242/614.1 |

FOREIGN PATENT DOCUMENTS

| | | |
|---|---|---|
| 11 70 215 | 5/1964 | (DE) . |
| 12 00 635 | 9/1965 | (DE) . |
| 19 28 420 | 12/1965 | (DE) . |
| 19 38 421 | 5/1966 | (DE) . |
| 69 46 879 | 7/1971 | (DE) . |

* cited by examiner

*Primary Examiner*—Michael R. Mansen
(74) *Attorney, Agent, or Firm*—Finnegan, Henderson, Farabow, Garrett & Dunner, L.L.P.

(57) ABSTRACT

A reel for supporting optical fibres includes a winding drum having a tubular cylindrical shape, a pair of containing flanges, each of which is positioned close to one end edge of the winding drum, a central core positioned coaxially inside the winding drum, and at least one pair of interconnecting flanges positioned either side of a transverse median plane of the reel, each of which extends from the central core to the winding drum. The interconnecting flanges are at least partly frustoconical in shape and are joined directly to the winding drum with their frustoconical part at attachment points, and to the central core at anchor points. The anchor points are positioned closer to the transverse median plane of the reel than are the attachment points so as to form an angle between the interconnecting flanges and the central core of amplitude such as to limit deformation of the pair of containing flanges during rotation of the reel.

16 Claims, 4 Drawing Sheets

FIG. 2
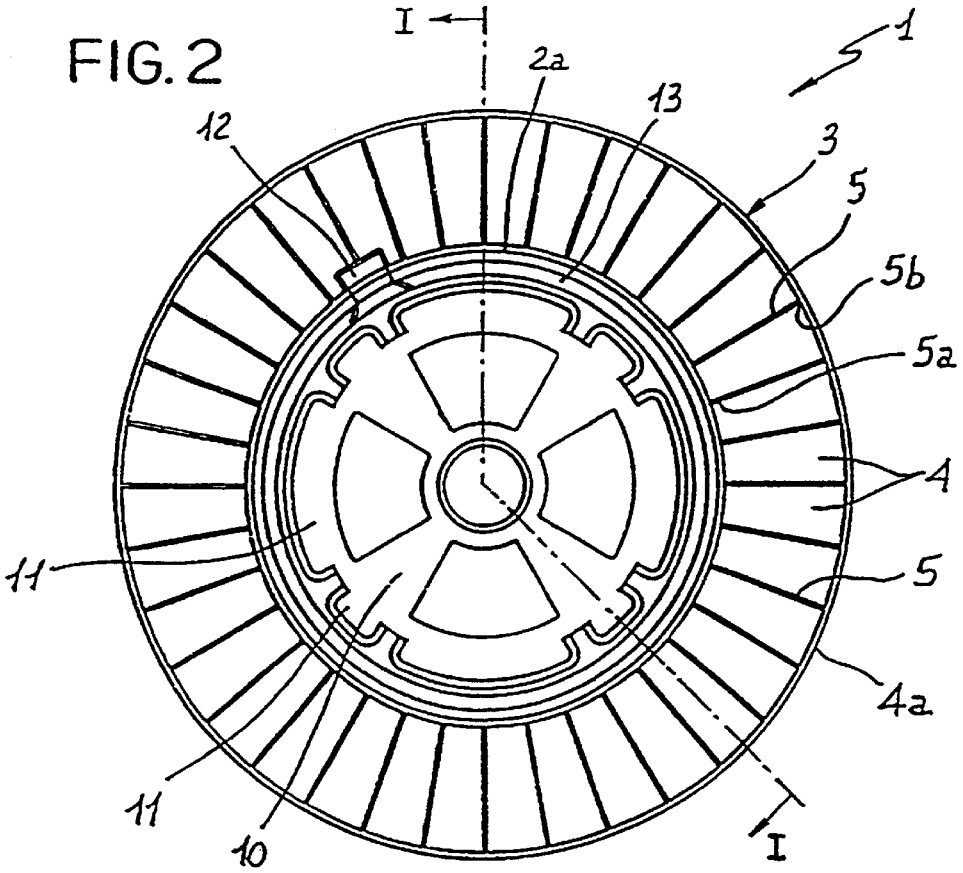
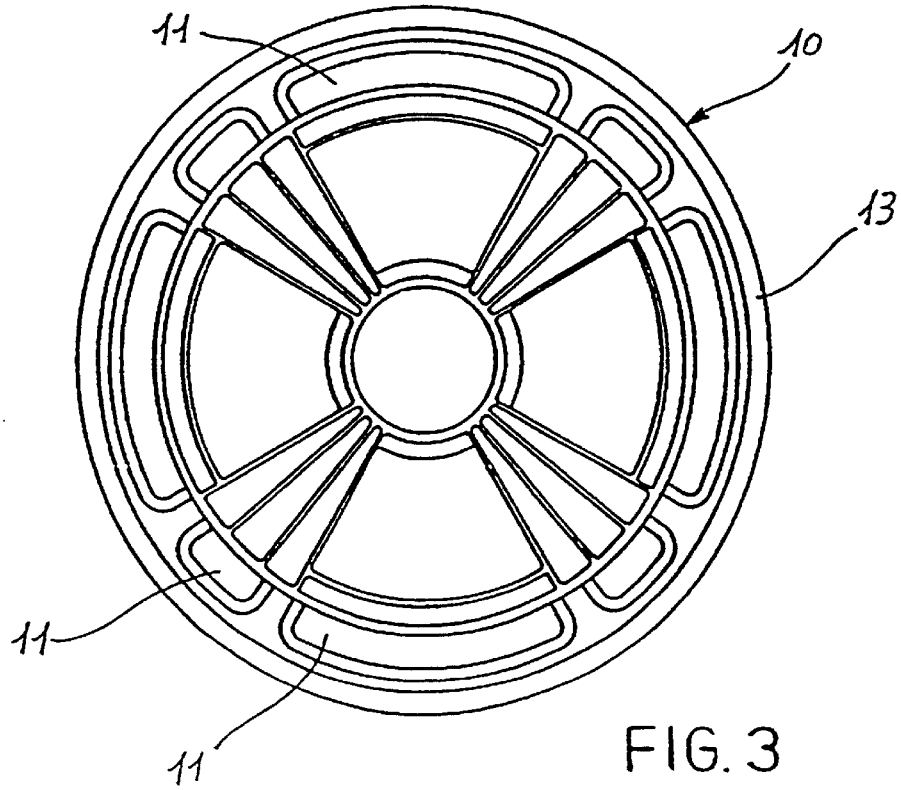
FIG. 3

REEL AND METHOD FOR SUPPORTING OPTICAL FIBRES

This application is a continuation of International Application No. PCT/EP98/06969, filed Nov. 4, 1998, in the European Patent Office the contents of which is incorported herein by reference; additionally, Applicant claims the right; of priority under 35 U.S.C. §119(a)–(d) based on patent application Ser. No. 97119380.0, filed Nov. 6, 1997, in the European Patent Office; further, Applicant claims the benefit under 35 U.S.C. §119(e) based on prior-filed, copending provisional application No. 60/064,470, filed Nov. 6, 1997, in the U.S. Patent and Trademark Office; the contents of all of which are relied upon.

The present invention relates to a reel for supporting optical fibres. A further aspect of the present invention also relates to a method for controlling the deformations experienced by the said reel as at least one optical fibre is wound onto it.

During production of optical fibres, the fibre being made is neatly collected by winding it onto a suitable support reel at the end of the production cycle or of a given intermediate stage thereof.

These reels essentially comprise a cylindrical winding drum having two radial containing flanges which extend circumferentially from around its opposite end edges and whose function is laterally to contain the fibre coil wound onto the drum.

Housed coaxially inside the winding drum is a central core which is also tubular and is used to engage the reel on a shaft or other support means installed in the fibre winding station. The central core is connected to the drum by a pair of interconnecting flanges which each essentially extend along a plane between an end edge of the central core and the corresponding end edge of the winding drum.

U.S. Pat. No. 4,657,203 discloses a reel for optical fibres or cables that comprises a cylindrical drum which has two discs at its opposite axial ends for containing the fibres wound onto the drum. This drum has a central core positioned inside it and a plurality of spokes that extend radially out from the said core to the drum. At least one of these spokes has a notch for gripping the end of the cable or fibre inside it. The drum has an aperture to allow the end of the fibre to begin to be wound onto it.

U.S. Pat. No. 5,236,145 discloses a spool for winding a conductor comprising a tubular core and two identical plates, each of which is joined to one of the lateral ends of the said core. The peripheral part of both plates forms a flange for containing the wound conductor, the internal side of which is smooth and the external side of which has a peripheral ring and an intermediate ring between which there are a plurality of radially extending spokes. These rings and spokes give the reel rigidity and strength.

U.S. Pat. No. 4,696,438 discloses a reel for winding an optical fibre comprising a circular hub and a first and second frustoconical flange attached to the opposite ends of the circular hub, with the smaller diameter nearest the hub. Each of the flanges has a notch in which to insert an optical fibre. On the outside of one of the two flanges there is a fastening means which receives the beginning of the fibre to be wound and comprises a recess defined by the flange and by an external cylindrical surface. The recess communicates easily with the notch so that the end of the optical fibre can be inserted into the hub on which it will be fully wound. The utility model DE4946879 discloses a reel made in a plastic material for winding on it metallic wires. The reel comprises a winding drum, a pair of containing flanges each of which is positioned close to one of the end edges of the said drum, and interconnecting flanges composed by a hub element, a conical element and a wall element. A filling material is inserted into containing flanges to provide a protection for the same flanges.

The applicant has observed that the flanges or spokes that connect the drum to the core or hub of a reel constitute the most critical point of the reel structure, allowing the latter to withstand centrifugal forces and thereby limiting deformation of the said drum, and of the reel in general, as it rotates; the best deformation resistance allows problem-free winding of the fibres onto the drum at higher speeds.

It has been found, therefore, in accordance with the present invention, that it is possible to limit—or at all events control—the deformations experienced by the containing flanges and the drum of the reel as a result of centrifugal forces if the said interconnecting flanges are positioned at an angle between the drum and the core of the reel, so as to form a frustoconical element.

Moreover, if the point at which the interconnecting flanges are attached to the drum is set axially outside the point at which the corresponding containing flange joins the drum, the advantages are even more apparent, especially when the reel is rotated at high speed.

In short, the reel is endowed with greater structural strength to withstand the stresses generated by centrifugal forces, and it simultaneously becomes possible to reduce the amount of material used to make the reel and, therefore, its cost.

More specifically, one aspect of the present invention relates to a reel for supporting optical fibres comprising a winding drum having a tubular cylindrical shape, a pair of containing flanges, each of which is positioned close to one of the end edges of the drum, a central core positioned coaxially inside the winding drum, and at least one pair of interconnecting flanges positioned either side of a transverse median plane of the reel, each of which extends from the central core to the winding drum, characterized in that the interconnecting flanges are at least partially frustoconical in shape and are joined directly to the winding drum with their frustoconical part at an attachment point and to the central core at an anchor point, the anchor point being positioned closer to the transverse median plane of the reel than is the attachment point so as to form a given angle, between the interconnecting flange and the core, of amplitude such as to limit deformation of the containing flanges during rotation.

Advantageously, each of the containing flanges is secured to the winding drum at a junction point positioned closer to the transverse median plane of the reel than is the attachment point.

In particular, the points at which the interconnecting flanges are attached to the winding drum are located between 3 and 10 mm away from the junction points of the corresponding containing flanges.

This given angle is preferably between 35° and 55°.

More specifically, the interconnecting flanges are frustoconical in shape and are positioned as mirror images of each other.

In a preferred embodiment, the interconnecting flanges are joined to the central core at essentially a common point.

In accordance with possible variants of the invention, the interconnecting flanges are joined to the central core at anchor points set a certain distance apart, or are joined to the central core by means of a disc-shaped connecting portion which extends radially out from the central core along the transverse median plane of the reel.

According to a further preferred feature of the invention, each containing flange has a containing wall positioned along a diametric plane of the reel and a plurality of radial reinforcing ribs distributed around the circumference of the containing wall, on the external side of the reel.

The longitudinal length of the above-mentioned ribs is preferably essentially equal to the distance between each of the junction points and the corresponding attachment point.

In a preferred embodiment, the reel in question also comprises a pair of disc-shaped closure elements, each of which is fixed to one end of the central core and carries means for gripping one end of an optical fibre wound on the reel.

Each of the disc-shaped elements is advantageously attached to one of the interconnecting flanges by means of a frustoconical outer edge which bears against the said interconnecting flange.

Further in accordance with the present invention, a method is provided for controlling the deformation of a reel for supporting optical fibres comprising a cylindrical winding drum, radial containing flanges on each end of the said drum, and a central core positioned coaxially inside the winding drum, the method being characterized in that it limits the degree to which the junction zone between the containing flanges and the drum rotates towards the median plane of the drum by securing an attachment point of said interconnecting flanges on the winding drum to an anchor point of said interconnecting flanges on the central core forming a structural bond which opposes this rotation in a direction that converges to the median plane of the central core.

The anchor point is preferably positioned closer to the transverse median plane of the reel than is the attachment point.

The method also comprises the stage in which the containing flanges are secured to the winding drum at a junction point positioned closer to the transverse median plane of the reel than is the attachment point.

The distance between each junction point and the corresponding attachment point is preferably between 3 and 10 mm.

This description will be given below with reference to the accompanying drawings, which are provided solely for illustrative purposes and are not, therefore, limiting. In the drawings:

FIG. 2 is a side view on a reduced scale of the reel in question;

FIG. 3 shows a disc-shaped closure element associated with the reel in question, seen from the opposite side to that shown in FIG. 2;

Figure 1:
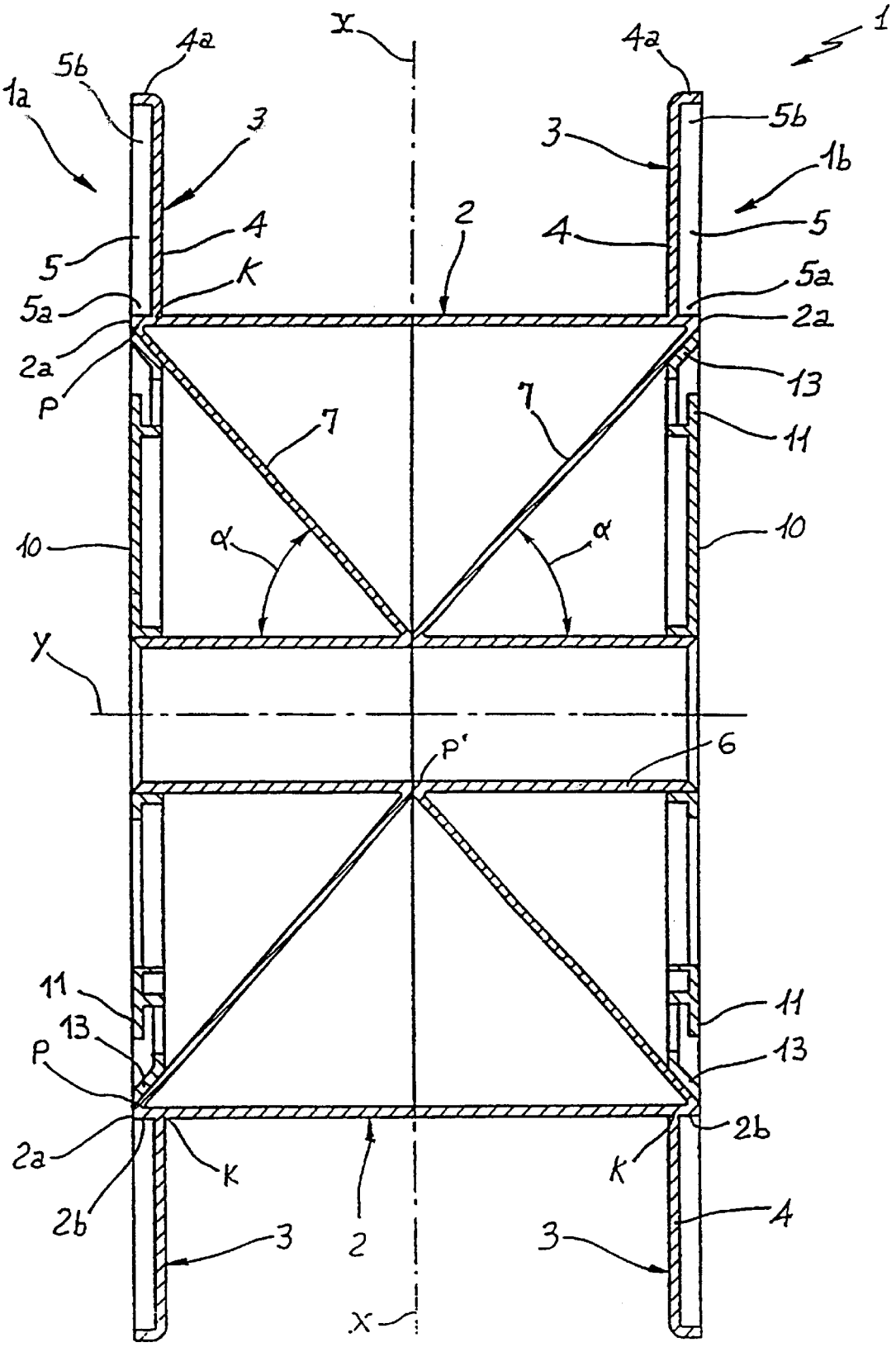
FIG. 1 is a section through a reel according to the present invention, taken:on the plane I—I in FIG. 2.

With reference to the above figures, and in particular to FIGS. 1 and 2, a reel for supporting optical fibres according to the present invention has been denoted overall by the reference numeral 1.

The reel 1 can normally be made as two half-shells 1*a*, 1*b* from injection-moulded plastic, these two half-shells then being joined together by means of adhesive bonding or welding along a transverse median plane X—X of the reel.

The reel 1 comprises a winding drum 2 with a tubular cylindrical structure and two containing flanges 3 which extend from a point close to its opposite end edges 2*a*.

Each containing flange 3 essentially has a delimiting wall 4 extending along a diametric plane of the drum 2, and a plurality of radial ribs 5 distributed around its circumference, on the opposite side to that facing the other containing flange 3.

As can be clearly seen in FIG. 2, each of the containing flanges 3 is fixed to the drum 2 via the radially internal edge of its delimiting wall 4. More specifically, the delimiting wall 4 is joined to the drum at a junction point K which is located a short distance away from the adjacent end edge 2*a* of the said drum.

In other words, the drum 2 has terminal projecting portions 2*b* which extend beyond the junction points K where the containing flanges 3—or, more specifically, the delimiting walls 4 of the latter—are joined.

The radial ribs 5 of each containing flange 3 each have radially internal ends 5*a* which are fixed to the projecting portions 2*b* of the winding drum 2.

A rim 4*a*, which extends out from the outer circumferential edge of the delimiting wall 4, runs around the radially external ends 5*b* of the ribs 5.

The reel 1 also has a central core 6, preferably with a tubular cylindrical shape, positioned coaxially inside the winding drum 2.

The central core 6 is connected to the winding drum 2 by means of at least one pair of interconnecting flanges 7, which are positioned symmetrically relative to a transverse median plane X—X of the reel 1 and each of which extends from the central core 6 to the winding drum 2.

Said interconnecting flanges comprise one segment which are extended from winding drum 2 to the central core 6.

Each of the interconnecting flanges 7 is joined to the winding drum 2 at least one attachment point P which is set a certain distance away from the junction point K of the corresponding containing flange 3, towards the end edge 2*a* of the winding drum.

More specifically, in a preferred embodient, the attachment point P of each interconnecting flange 7 is positioned essentially on the end edge 2*a* of the winding drum 2.

Advantageously, the fact that the attachment points P are positioned a certain distance away from the junction point K ensures that the interconnecting flanges 7 efficiently help to counteract the tendency of the containing flanges 3 to deform under the effect of centrifugal forces when the reel is rotated at high speed about its geometric axis Y as the optical fibre is wound onto it.

It is worth pointing out at this stage that, under the effect of these centrifugal forces, the containing flanges 3 tend to rotate about their junction points K, with their outer circumferential edges moving towards the transverse median plane X—X.

In the reel of the invention, this tendency is effectively counteracted by the interconnecting flanges 7 which react at their respective attachment points P and, on account of the distance between the points P and X, generate a reaction moment which opposes the forces tending to cause the containing flanges 3 to rotate about their junction points K.

The distance between the attachment point P and the junction point K needs to be chosen on the basis of the geometric and dimensional parameters of the reel 1 and of the material from which it is made.

The interconnecting flanges 7, which are positioned as mirror images of each other, are inclined so that they converge onto the central core 6 towards the transverse median plane X—X.

In the preferred embodiment illustrated, the interconnecting flanges 7, which are frustoconical in shape, converge onto the central core 6, essentially joining it at a common anchor point P', preferably at an angle a of approximately 45°.

For the purposes of the present invention, the attachment point P, the anchor point P' and the junction point K have been defined as seen relative to the reel's transverse plane—denoted in the figures as the plane I—I—and therefore in a cross-section of the reel shown in the figures; on the reel as a whole, the said points correspond to circumferences whose centres lie on the rotational axis of the reel.

It has been found that when the angles a are 45°, the interconnecting flanges 7 advantageously lie in the direction of the resultant forces generated at the attachment points P as a result of centrifugal forces. These angle values are therefore essentially regarded as the most advantageous for the purposes of the present invention.

Under these circumstances, the ratio between the axial length of the winding drum 2 and the difference between the diameters of the winding drum and the central core 6 is essentially 1.

If this dimensional ratio is greater than or less than 1, the angle a can be adapted appropriately within a range of, for example, between 35° and 55°, so that the interconnecting flanges 7 still converge at a common anchor point an the central core 6.

Figure 4:
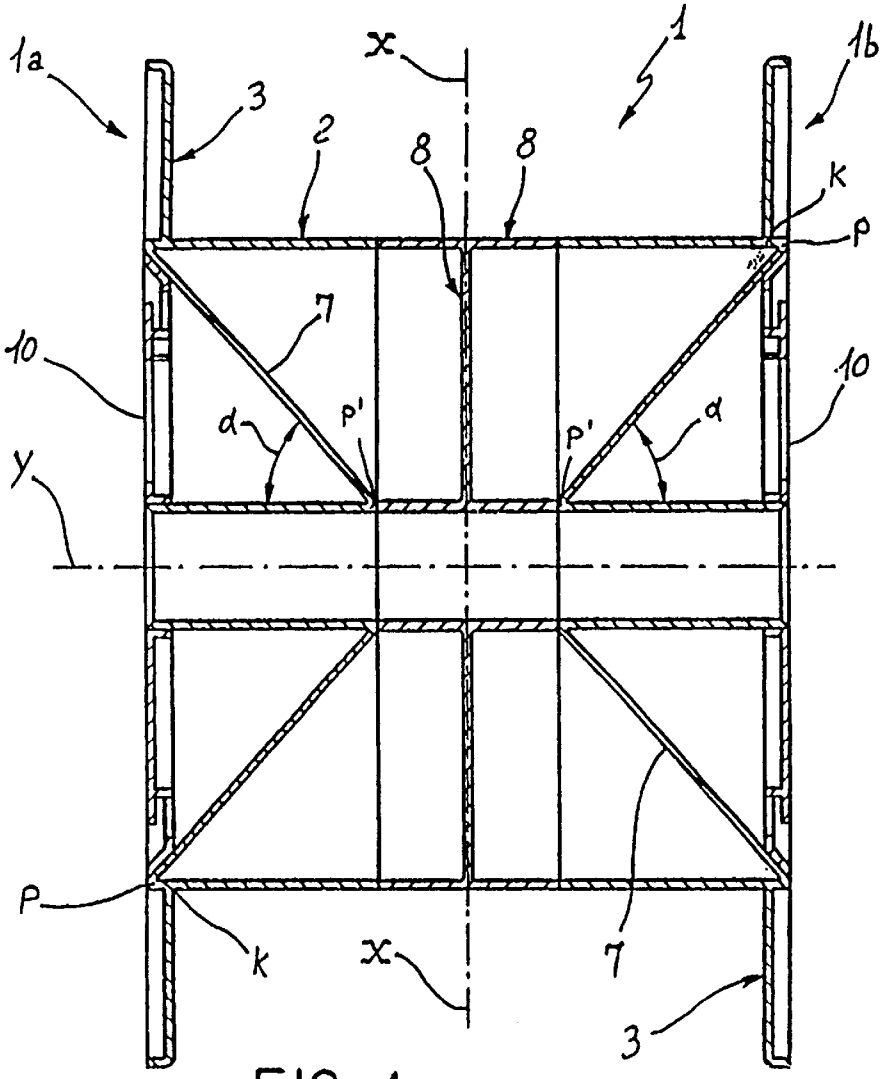
FIG. 4 shows a cross-section on a reduced scale of a first variant embodiment of the reel in question.

However, the possibility of the interconnecting flanges 7 joining the central core 6 at anchor points P' set a certain distance apart, as illustrated in FIG. 4, should not be excluded. In this case, at least one spacer element 8 can be inserted between the half-shells 1*a*, 1*b* that make up the reel 1.

Figure 5:
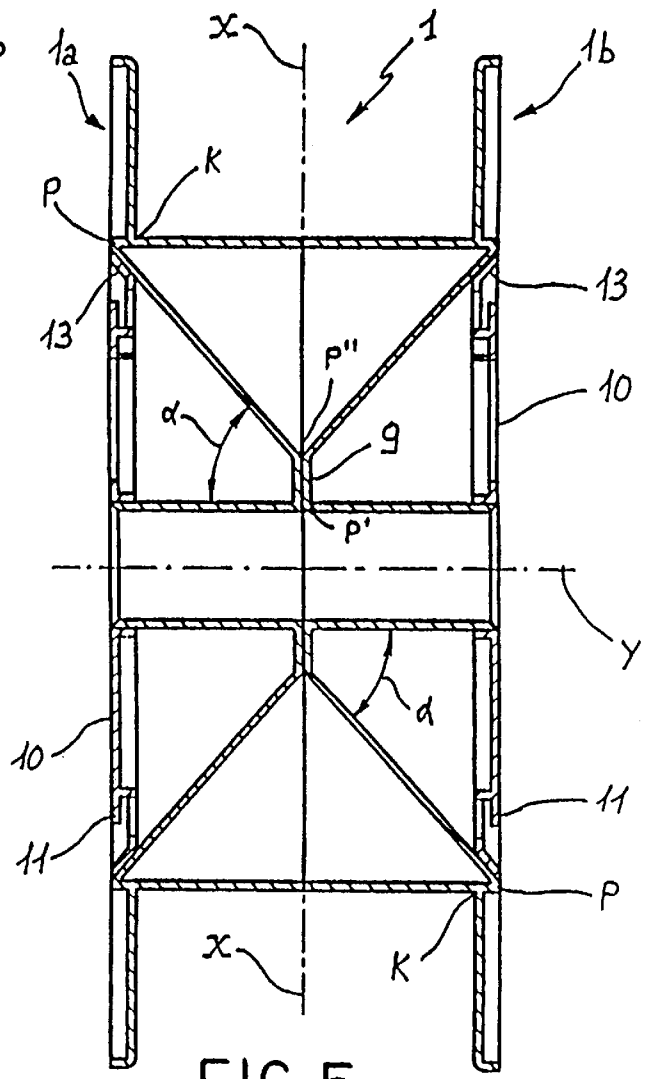
FIG. 5 is a cross-section on a reduced scale of a second variant embodiment of the reel.

Alternatively, as illustrated in FIG. 5, the interconnecting flanges 7 could both be made to converge at a mutual point P", set diametrically away from the central core 6, and be connected to the latter by means of a disc-shaped connecting portion 9 which extends radially out from the said central core along the transverse median plane X—X of the reel 1.

In each case, the anchor point P' of each interconnecting flange 7 is aligned with the corresponding attachment point P in a direction which is inclined relative to the longitudinal axis Y of the reel 1.

In a reel in which the winding drum 2 has an outer diameter of approximately 152 mm, with containing flanges 3 having an outer diameter of approximately 236 mm, excellent results have been obtained when each junction point K is set about 4 mm away from the adjacent attachment point P.

This distance can, however, be chosen from within a range of, for example, between 3 and 10 mm.

Distances greater than that described could give rise to undesirable stresses being generated under the effect of centrifugal forces, on account of the mass of the material inserted between the attachment point P and the junction point K, while shorter distances could excessively reduce the reaction moment generated by the interconnecting flanges 7.

The reel 1 also comprises a pair of disc-shaped closure elements 10, each of which is fixed to one end of the central core 6. Each of these closure elements 10 is equipped with gripping means, for example in the form of radial fins 11 distributed around its circumference, which can be used to fasten the end of the optical fibre (not shown) which is to be wound on the reel. The end of the optical fibre reaches the gripping means 11 through an aperture 12 provided specifically for this purpose in at least one of the containing flanges 3.

Advantageously, each disc-shaped element 10 is attached to one of the interconnecting flanges 7 by means of its frustoconical outer edge 13.

This outer edge 13 is preferably axially offset towards the transverse median plane X—X relative to the said disc-shaped element and only bears against the corresponding interconnecting flange 7, without being firmly fixed to it.

The constructional characteristics of the reel in question allow any deformation thereof to be effectively controlled, especially in the containing flanges 3, even when the optical fibre or fibres are being wound onto it at high speed.

This also results in a considerable reduction in the weight of the reel structure which in turn gives an appreciable saving in the quantities of plastic used, and hence a sizeable reduction in production costs.

It should be remembered at this point that reels of this type are designed to be used only once, and therefore their production costs, virtually all of which are made up of the material used, are of crucial importance.

The fact that the present invention makes it possible to control the deformation of the containing flanges 3 means that the reel in question can be used even in the most exacting conditions demanded by modern optical fibre production technology.

It is also worth pointing out in this respect that the optical fibres made or treated in modern production plant are travelling at speeds which can easily reach and even exceed about 1800 m/min. Bearing in mind that the outer diameter of the winding drum is usually around 15 cm, such speeds of travel of the fibre mean that the reel needs to rotate at speeds equal to or above 3600 revolutions per minute.

With reels made according to the prior art, it was very difficult—if not downright impossible—to reach and maintain similar speeds of rotation because of the deformations experienced by the containing flanges under the effect of centrifugal forces, the problem being, it should be realized, that if the outer edge of the containing flange moved axially by an amount equal to or greater than the diameter of the fibre being wound (usually about one tenth of a mm) this would result in the fibre being wound incorrectly, with the possible risk of the fibre being damaged and/or breaking.

In the reel according to the present invention, the deformation experienced by the containing flanges is always contained within acceptable limits, even at extremely high rotational speeds.

Figure 6:
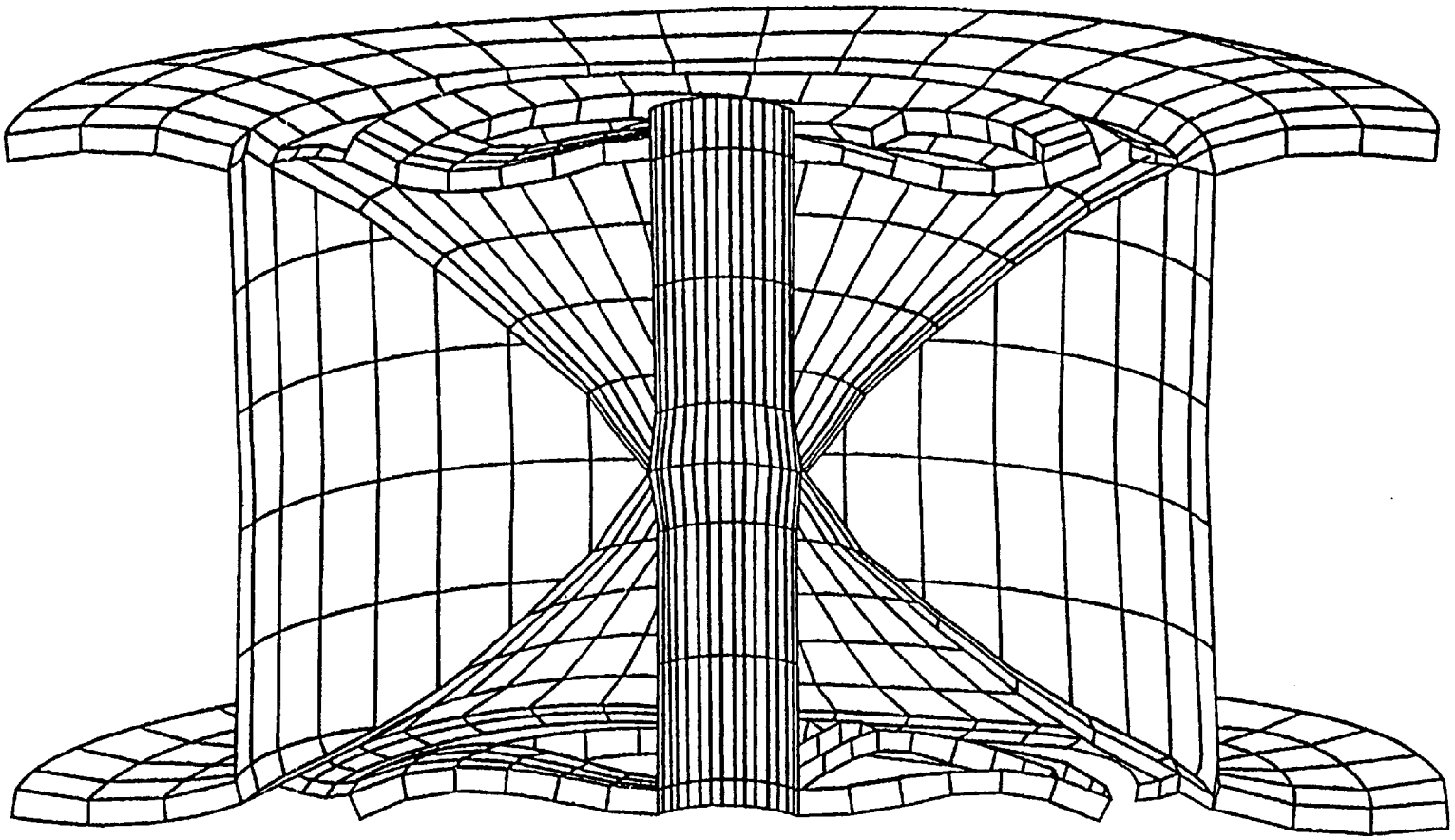
FIG. 6 is a graphic representation, produced using a structural finite element analysis computer program, illustrating the deformations experienced by a reel according to the invention and made from ABS, when it is rotated at a speed of 6000 revolutions per minute.

FIG. 6 is a graphic representation illustrating the deformations experienced by a reel made of ABS according to the invention. In this graphic representation, produced using a finite element analysis computer program, the deformations have been deliberately amplified.

As can be seen, the containing flanges tend to take on a curved profile extending essentially along the continuation of the interconnecting flanges. More specifically, each containing flange has a radially internal portion which moves slightly away from the profile normally assumed by the flange under rest conditions, that is away from the transverse median plane X—X, while a radially external portion of the said flange moves closer to the transverse median plane, causing the outer circumferential edge of the flange essentially to coincide with the ideal profile in the rest state.

Under these circumstances the deformations of the containing flanges are controlled and effectively distributed along the whole radial extension of the said flange, thereby minimizing any adverse effects on the quality of winding achieved.

What is claimed is:

1. A reel for supporting optical fibres, comprising:

a winding drum having a tubular cylindrical shape;

a pair of containing flanges, each of which is positioned close to one end edge of the winding drum;

a central core positioned coaxially inside the winding drum; and at least one pair of interconnecting flanges positioned either side of a transverse median plane of the reel, each of which extends from the central core to the winding drum;

wherein the interconnecting flanges are at least partly frustoconical in shape and are joined directly to the winding drum with their frustoconical part at attachment points, and to the central core at anchor points, the anchor points being positioned closer to the transverse median plane of the reel than are the attachment points so as to form an angle between the interconnecting flanges and the central core of amplitude such as to limit deformation of the pair of containing flanges during rotation of the reel.

2. The reel of claim 1, wherein each of the containing flanges is secured to the winding drum at a junction point positioned closer to the transverse median plane of the reel than is the attachment point.

3. The reel of claim 1, wherein the attachment points at which the interconnecting flanges are attached to the winding drum are located between 3 mm and 10 mm away from junction points of the corresponding containing flanges.

4. The reel of claim 1, wherein the angle is between 35° and 55°.

5. The reel of claim 1, wherein the interconnecting flanges are positioned as mirror images of each other.

6. The reel of claim 1, wherein the interconnecting flanges are joined to the central core at essentially a common point.

7. The reel of claim 1, wherein the interconnecting flanges are joined to the central core at points set a certain distance apart.

8. The reel of claim 1, wherein the interconnecting flanges are joined to the central core by means of a disc-shaped connecting portion which extends radially out from the central core along the transverse median plane of the reel.

9. The reel of claim 1, wherein each containing flange has a delimiting wall positioned along a diametric plane of the reel and a plurality of radial reinforcing ribs distributed around a circumference of the delimiting wall on an external side of the reel.

10. The reel of claim 9, wherein a longitudinal length of the reinforcing ribs is essentially equal to a distance between a junction point and a corresponding attachment point.

11. The reel of claim 1, further comprising a pair of disc-shaped closure elements, each of which is fixed to one end of the central core and includes means for gripping one end of an optical fibre wound on the reel.

12. The reel of claim 11, wherein each disc-shaped element is attached to one of the interconnecting flanges by means of a frustoconical outer edge which bears against the interconnecting flange.

13. A method for controlling deformation of a reel for supporting optical fibres, wherein the reel comprises:

a cylindrical winding drum;

radial containing flanges on each end of the winding drum;

a central core positioned coaxially inside the winding drum; and at least one pair of interconnecting flanges positioned either side of a transverse median plane of the reel, each of which extends from the central core to the winding drum;

the method comprising the steps of:

securing the interconnecting flanges to attachment points on the winding drum; and securing the interconnecting flanges to anchor points on the central core;

wherein the steps of securing the interconnecting flanges to the attachment points and anchor points limits a degree to which a junction zone between the containing flanges and the winding drum rotates towards the transverse median plane of the reel.

14. The method of claim 13, wherein the anchor points are positioned closer to the transverse median plane of the reel than are the attachment points.

15. The method of claim 13, wherein the containing flanges are secured to the winding drum at junction points positioned closer to the transverse median plane of the reel than are the attachment points.

16. The method of claim 15, wherein a distance between each junction point and a corresponding attachment point is between 3 mm and 10 mm.

* * * * *